US005289713A

United States Patent [19]

Schäfer

[11] Patent Number: 5,289,713

[45] Date of Patent: Mar. 1, 1994

[54] DEVICE FOR CONNECTING A WIRE TO A PLUG, CONTACT ELEMENT OR THE LIKE WITH CRIMP HEIGHT ADJUSTMENT

[75] Inventor: Bernhard Schäfer, Mühlhausen-Rettigheim, Fed. Rep. of Germany

[73] Assignee: Bernhard Schafer Werkzeug-U. Sondermaschinenbau GmbH, Schonborn-Langenbrucken, Fed. Rep. of Germany

[21] Appl. No.: 963,616

[22] Filed: Oct. 20, 1992

[30] Foreign Application Priority Data

Nov. 12, 1991 [DE] Fed. Rep. of Germany ..... 4137163

[51] Int. Cl.[5] ..... B21J 13/00; H01R 43/04

[52] U.S. Cl. ..... 72/446; 72/481; 72/413; 29/753; 100/257

[58] Field of Search ..... 72/446, 481, 482, 441, 72/413; 29/753, 748; 100/257

[56] References Cited

U.S. PATENT DOCUMENTS

| | | | |
|---|---|---|---|
| 3,911,717 | 10/1975 | Yuda | 29/753 |
| 4,718,160 | 1/1988 | Bulanda et al. | 29/748 |
| 4,790,173 | 12/1988 | Boutcher | 72/446 |
| 4,970,889 | 11/1990 | Phillips et al. | 72/482 |
| 5,084,960 | 2/1992 | Yeumans | 29/753 |
| 5,095,599 | 3/1992 | Gloe et al. | 29/753 |

*Primary Examiner*—Daniel C. Crane
*Assistant Examiner*—Michael J. McKeon
*Attorney, Agent, or Firm*—Bachman & LaPointe

[57] ABSTRACT

In a device for connecting a wire to a contact element or the like by deformation of clamping members by means of pressure elements of a crimping tool arranged interchangeably in a press, for the purposes of refining the adjustability in respect of height, coaxially rotatably associated with an adjustment disk (13) which is provided at the pressure member side and which is rotatable about the axis (A) of an arresting pin (16) or the like holding member which faces in the pressing direction (x) is a further adjustment disk (14) at the clamping member side, wherein the two adjustment disks are each provided with at least one annular surface (108) which rises spiral-like in the pressing direction (x). Each of the annular surfaces (108) has a radial step edge (110) as the boundary between the beginning and the end of the rise. The heights of the step edges are also to be the same.

15 Claims, 5 Drawing Sheets

DEVICE FOR CONNECTING A WIRE TO A PLUG, CONTACT ELEMENT OR THE LIKE WITH CRIMP HEIGHT ADJUSTMENT

BACKGROUND OF THE INVENTION

The invention concerns a device for connecting a wire to a contact element or the like by deformation of clamping members of the contact element or the like by means of pressure members, in particular pressure members of a crimping tool which is arranged interchangeably in a press.

Devices of that kind for cable manufacture, for example for fixedly connecting wire ends to plugs and cable shoes, usually comprise an impact press with a vertically moved press ram which acts on a pressure head of the crimping tool which is arranged therebeneath, wherein crimping rams which are provided in the tool are moved downwardly and secure a horizontally inserted plug member or the like contact element to a cable or wire end, with deformation of clamping lugs. The end of the wire or cable is stripped of insulation to a given length so as to provide a diameter which is smaller than the insulated portion of the cable or wire. The so-called crimp height of the operative ram edge or edges, which is required to carry out the described crimping operation, is adjusted by hand in dependence on the wire cross-sections or the shape of the contact element.

In order to adjust the crimp heights, use has hitherto been made for example of rotary heads with surfaces of different heights, as disclosed in German published specification (DE-AS) No 15 15 395. In such arrangements, the various levels in respect of height are predetermined in regard to the number thereof, with the result that, when the tool is transferred to another press of a different size and with different dead center points, the adjustment range is possibly no longer adequate. That also applies in regard to contacts which have a very wide range in respect of the cable which is to be fixed thereto. If for example a cable cross-section of 0.5 $m^2$ is fixed, a pressing depth of 1.2 mm is required, while with a cross-section of 4 $mm^2$, the pressing depth is about 2.8 mm.

Also known are so-called wedge-type adjusting arrangements which admittedly permit stepless adjustment of the insulation or wire crimper, but which suffer from the following disadvantages:

- a tool is required for loosening screwthreaded pins;
- controlled adjustment is not possible;
- the pressure point of the press lies outside the center point of the tool or is oriented at one side.

SUMMARY OF THE INVENTION

In consideration of that state of the art, the inventor set himself the aim, in a device of the above-specified kind, of eliminating the disadvantages encountered and refining and improving height adjustment. The invention also seeks to provide that the improved device can be subsequently fitted to existing presses and is automatically controllable with same.

The teaching of the present invention provides for the attainment of that object.

In accordance with the invention, coaxially rotatably associated with an adjustment disk which is provided at the pressure member side and which is rotatable about the axis of an arresting pin or like holding member which faces in the pressing direction, is a further adjustment disk disposed at the clamping member side, wherein both adjustment disks are each provided with at least one annular surface which rises in a spiral-like configuration in the pressing direction. A radial step edge is provided between the beginning and the end of each of the annular surfaces, as the boundary between the beginning and end of the rise.

It has been found desirable for the dimension of the height of the step edge to be the sam, in all step edges.

In accordance with a further feature of the invention, the adjustment disks are disposed coaxially one upon the other, wherein the adjustment disk at the clamping member side surrounds a pressure plate which is associated with a surface of the other adjustment disk, that is to say sits thereon.

In addition, in accordance with the invention, the pressure plate is to be dimensioned in such a way that it can be fitted into a central opening in the adjustment disk and at its surface is to be provided with two part-circular pressure faces of a rising surface, as support points for the adjustment disk lying thereabove.

It is also advantageous to provide the pressure plate at the other surf ace as a support surface with a wedge-like retaining projection or nose which projects therefrom; the retaining projection engages into a pressing block which in the normal situation is disposed therebeneath and thus serves as an anti-rotation means.

The pitch dimension of the pitch of the annular surface or pressure face, which rises in the clockwise direction, is to be 2.18 mm with a preferred outside diameter of the adjustment disk of 56 mm, or an outside diameter of the pressure plate of 42 mm.

In accordance with a further feature of the invention, associated with the bottom surface of the adjustment disk is a desk-like surface of an adjustment wedge, and the latter is also movably secured to a pressing block on the clamping member side.

There is provided a stepless rotary head with which the following advantages can be attained:

- defined adjustment, by way of a scale;
- stepless adjustment over a wide range;
- adjustment without a tool; and
- loss-free transmission of the pressing pressure.

In accordance with the invention an arresting pin serves as a mounting for an upper adjustment disk which is advantageously pressed by way of plate springs on to a pressure plate. The latter lies on a pressing block and is also fixed by the arresting pin which is screwed to the pressing block, and is prevented from rotating by a fitting engagement at the underside.

BRIEF DESCRIPTION OF THE DRAWINGS

Further advantages, features and details of the invention will be apparent from the following description of preferred embodiments and with reference to the drawings in which.

DETAILED DESCRIPTION OF PREFERRED EMBODIMENTS

Figure 1:
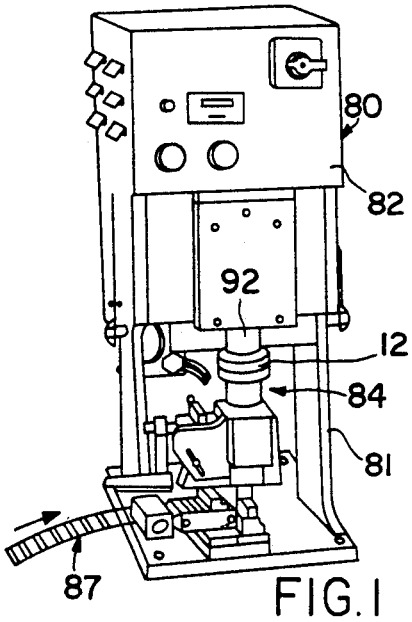
FIG. 1 is a perspective view of a device with a crimping tool in an impact press for connecting contact elements to wires.

An impact press 80 for dealing with wires or cables up to a line cross-section of 6 $mm^2$ comprises, beneath a press housing 82 which includes control and pressure arrangements and which is provided on support legs 81, a quick-change crimping tool 84 for connecting an insulated electrical wire 85 to a plug, contact element 88 or the like which has been severed from a sheet metal strip or line of blanks 87.

Figure 2:
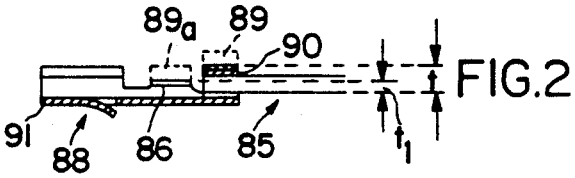
FIG. 2 is a view in longitudinal section through a wire with associated contact element.
Figure 3:
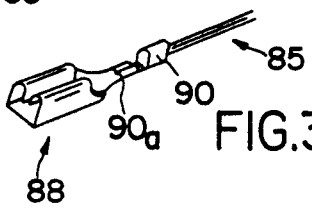
FIG. 3 is a perspective view of FIG. 2.

In the embodiment shown in FIGS. 2 and 3, lugs which are shown in broken lines at 89 and $89_a$ a respectively are pressed in embracing relationship or crimped on to the wire end 86 which has first been stripped of insulation, and the adjoining insulated wire 86, with deformation thereof to provide sleeve-like clamping portions 90, $90_a$, whose upper edges relative to the bottom 91 of the element are at different spacings t (insulation region) and $t_1$ (wire end region) (see FIG. 2). In the crimping operation the lugs 89, $89_a$ are rolled in so firmly that for example air inclusions are prevented.

The so-called crimp heights t, $t_1$ must be adjustable in order to be able to adapt the effect of deformation to the respective wire cross-section.

The device for adjusting the crimp height comprises two units, namely a guide portion 10 which is controlled by pneumatic and motor means and which is fixed to the press 80, and a portion to be adjusted, which is associated with the guide portion 10. The portion to be adjusted is an adjustment disk 12 which is screwed on to the crimping tool 84 and which is mounted to be rotatable.

Figure 4:
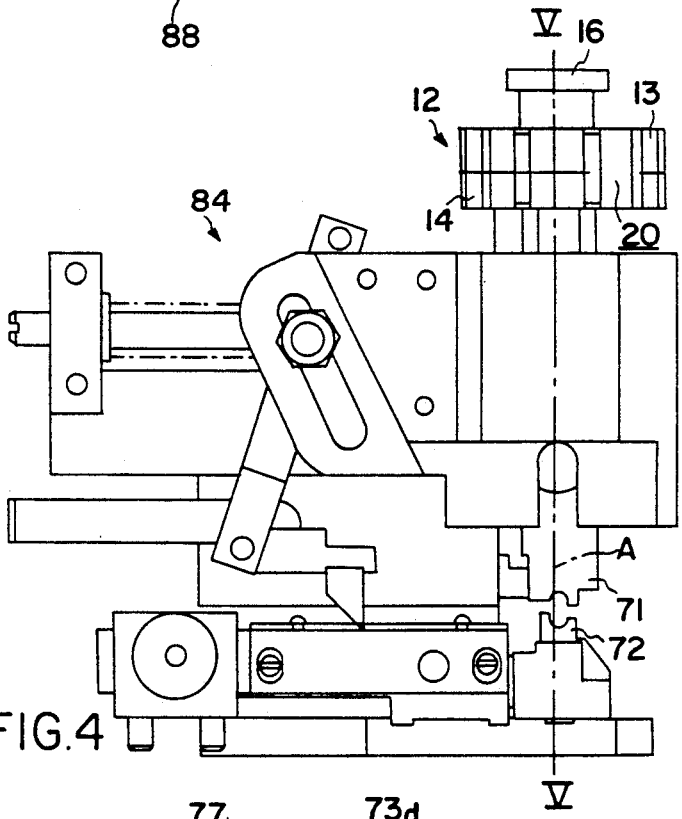
FIG. 4 is a front view of a crimping tool.
Figure 5:
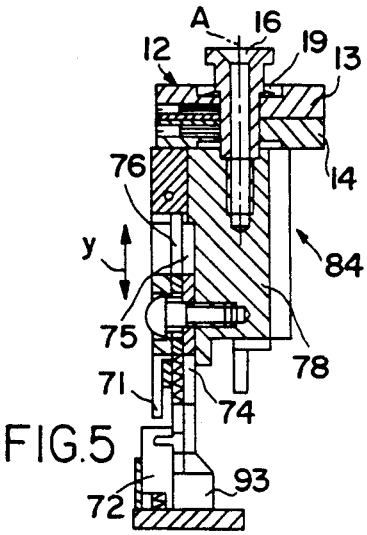
FIG. 5 is a view on a reduced scale of part of the crimping tool shown in FIG. 4 in section approximately along line V—V therein.
Figure 6:
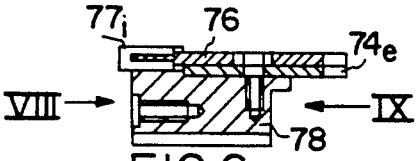
FIG. 6 shows a detail from FIG. 5 with crimping rams or punches in a lying position (pivoted through 90°)

In the construction shown in FIGS. 4 and 5, the adjustment disk 12 on the tool side comprises an upper disk 13 and a lower disk 14, through which pass a hollow arresting pin 16. The latter is surrounded by an inserted plate spring 19.

FIGS. 4 and 5 show a portion of the crimping tool 84 with the upwardly disposed adjustment disk 12 whose arresting pin 16 is carried in a pressing block 78 of the crimping tool 84. Disposed beneath the adjustment disk 12 are cringing rams or punches 74 and 76 which extend parallel and whose free lower edges $74_e$ and $76_e$ are respectively associated with the wire end 86 and the insulation portion 85. The crimping punches 74 and 76 are separated by way of the adjustment disks 13 and 14 from a press rain which is indicated at 92 in FIG. 1, and by a spacer bush or liner 75; the crimping punch 76 for the insulation portion 86 can be raised and lowered relative to the other cringing punch 74, as indicated by the arrow y in FIG. 5. FIG. 5 shows on the left in front of the insulation crimping punch 76 a pressure bar 71 for a blade 72 which is disposed therebeneath for severing the contact element 88 from the sheet metal strip 87 and, beside the blade 72, an anvil 93.

Figure 8:
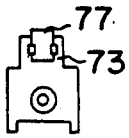
FIG. 8 is a view on arrow VIII in FIG. 6 without crimping punch.
Figure 10:
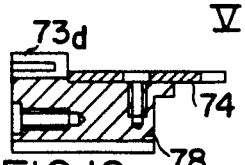
FIGS. 10 and 11 are views corresponding to FIGS. 6 and 7, of the detail, with only one crimping punch.
Figure 7:
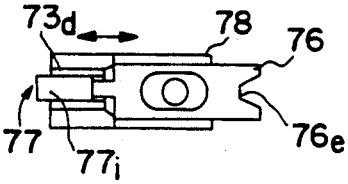
FIG. 7 shows a plan view of the FIG. 6 detail.
Figure 9:
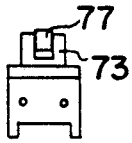
FIG. 9 is a view on arrow IX in FIG. 6 without crimping punch.
Figure 11:
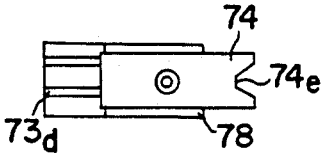

In FIGS. 7 through 9, reference 77 identifies a pressure surface, which is rectangular in cross-section, for the lower disk 14 with associated insulation crimping punch 76, while reference 73 indicates a pressure surface of a Unlike cross-section for the wire crimping punch 74. A bar portion $77_i$ of the me pressure surface 77 is displaceable in the channel profile $73_d$ of the other pressure surface 73.

It will be clear that both crimping punches 74 and 76 can be acted upon by the upper disk 13 of the adjustment disk 12, but that the lower disk adjusts the insulation crimper 76 and thus the difference in height between t and $t_1$ in FIG. 2.

Associated with the adjustment disk 12 is a control wheel 24 of the guide portion 10. The control wheel 24 also comprises top and bottom wheels 22 and 23 and it is provided with an axis B which is parallel to the axis A of the adjustment disk. Radial teeth 26 project from the control wheel 24. In the operative position shown in FIGS. 12 and 13, the radial teeth 26 mesh with engagement grooves 18 in the adjustment disk 12.

The control wheel 24 which is axially in two parts is disposed with toothed disks 27 screw& thereto rotatably in a front edge opening in a receiving plate 30 of the guide portion 10, and its shaft 32 is mounted at both ends in two axis plates 34 which extend across the edge opening above and below the receiving plate 30 and is fixed by radial pins. Each of the toothed disks 27 is connected by a toothed belt 36 or like elongate drive element to drive members 38, $38_t$, for example toothed gears, of stepping motors 40 and $40_t$ respectively.

Holding plates 42 extend from the receiving plate 30 parallel to the longitudinal axis M thereof and on both sides of the latter. A yoke portion 43 which is approximately U-shaped in plan view is clamped in position between the holding plates 42 and is connected thereto by cheese-head or cylindrical screws. Disposed at the head web part 44 of the yoke portion 43 is a miniature cylinder 46 whose piston rod 47 is connected to a transversely disposed guide web portion 48. Guide profile members 50 project from the web portion 48, parallel to the piston rod 47, and pass through corresponding mounting bushes 52 in the yoke portion 43, with their free ends being secured by stop blocks 54.

Figure 12:
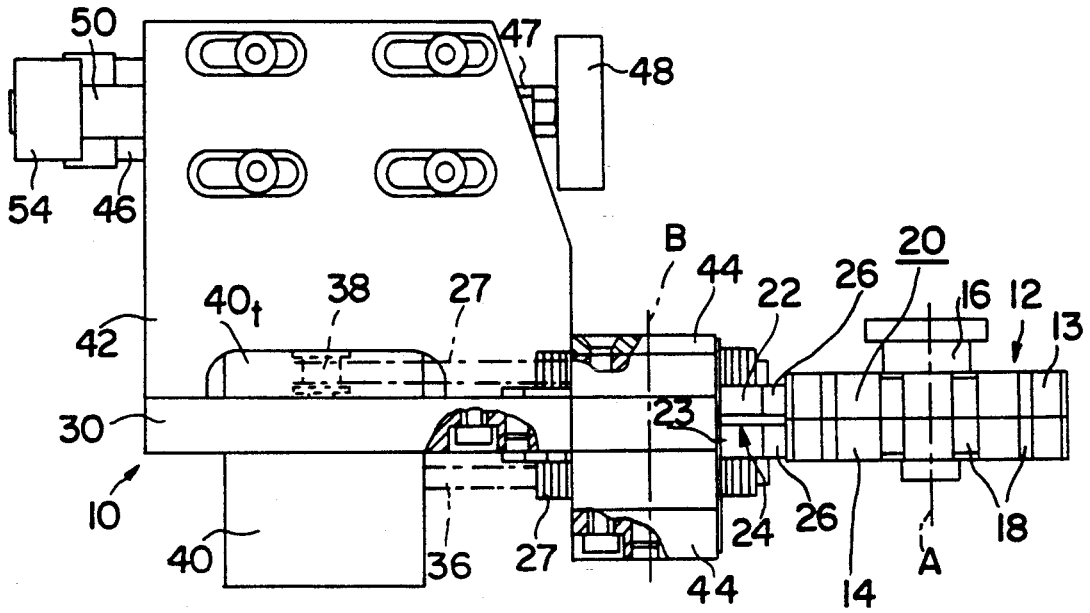
FIG. 12 is a side view on an enlarged scale of a part of FIG. 1 with an associated adjustment disk in the operative position.
Figure 13:
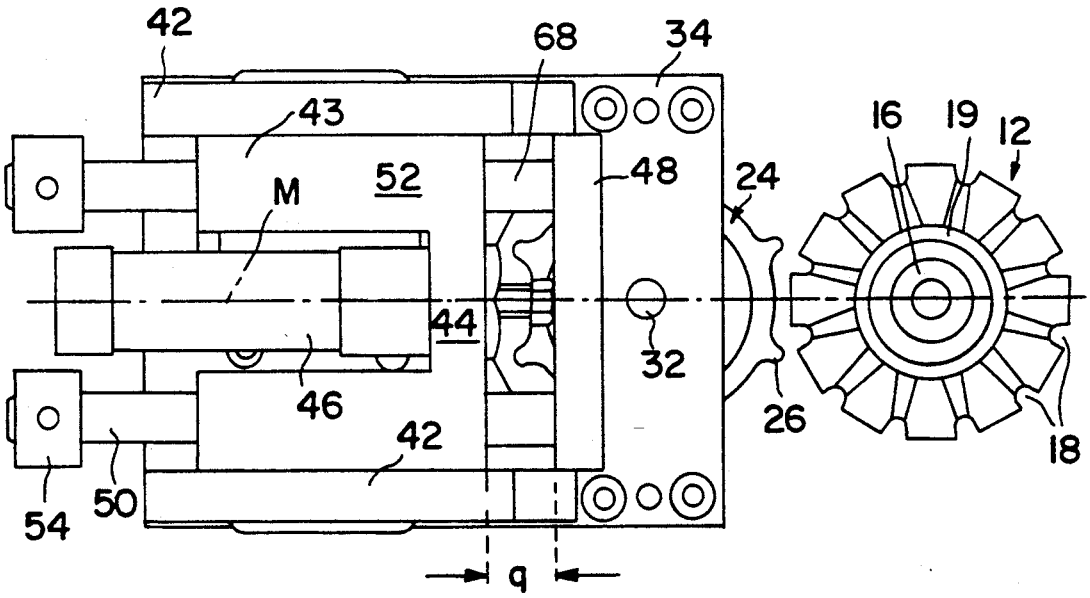
FIG. 13 is a plan view of FIG. 12.

When the miniature cylinder 46 is pneumatically actuated, the piston rod 47 is extended, thereby increasing the spacing q between the yoke portion 43 and the guide web portion 48, and thus moves the receiving plate 30 and the control wheel 24 or upper wheel 22 and lower wheel 23 out of the operative position in FIGS. 12 and 13 into a rest position in which the adjustment disk 12 and the control wheel 24 remain at a spacing relative to each other. Upon movement in the opposite direction, the control wheel 24 moves into the operative position and the radial teeth 26 of the top wheel 22 engage into the engagement grooves 18 in the upper disk 13 of the adjustment disk 12 in order further to rotate same by one notch. The control wheel 24 is then disengaged again from the adjustment disk 12 or the disk periphery 20 thereof and returns to the rest position. The lower wheel 23 correspondingly rotates the lower disk 14, in which respect the separate lower wheel drive $\mathbf{40}_t$ also permits a different direction of adjustment and a different pitch dimension in terms of the rotary movement.

In the case of the device according to the invention as shown in FIGS. 14 through 27, which is to be actuated manually, the arresting pin 16 serves as a mounting for an upper adjustment disk or top disk 13, with the interposition of at least one plate spring 19. The arresting pin 16 of a length a of about 35.5 mm and an outside diameter $d_1$ of about 14 m has, below its head 56 on its shank $\mathbf{16}_s$, a shoulder step 57 and an inside passage 58 of a diameter d of about 8 mm for a countersunk screw 60 whose conical head surface $\mathbf{60}_k$ in the locking position bears snugly against a corresponding opening 59 in the arresting pin 16. In the locking position the top disk 13 is pressed on to a pressure plate 15 which in turn applies a loading to the lower adjustment disk or bottom disk 14, in which respect the latter lies on an outer annular support surface 61 of the top disk 13.

Figure 14:
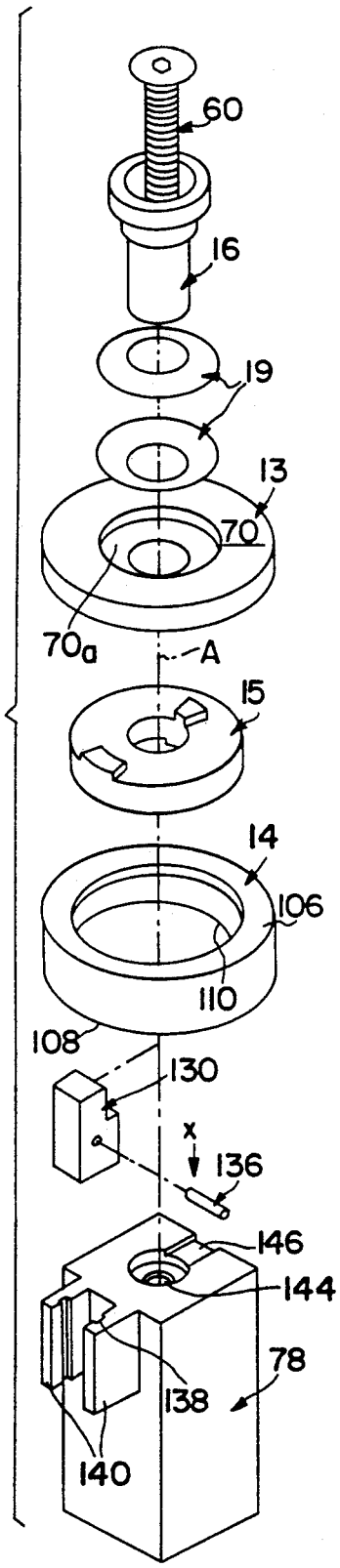
FIG. 14 is a perspective view of a plurality of parts of a device according to the invention, which are associated with each other at an axis.
Figure 15:
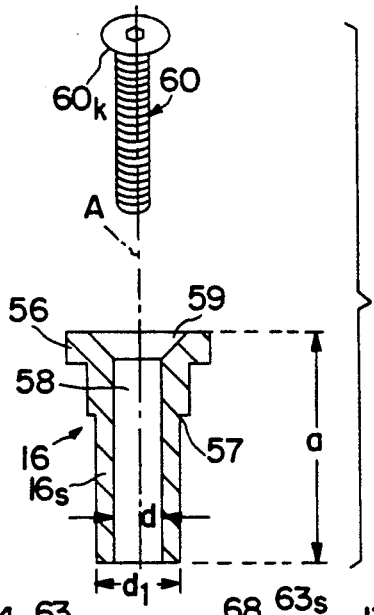
FIG. 15 shows a section through an arresting pin with associated countersunk screw, in a perspective view.

The top disk 13, of a mean height f of about 12 mm, affords a collar 62 of a diameter $e_1$ of 56 mm, the peripheral surface thereof being identified by $\mathbf{62}_s$. The support surface 61 surrounds an annular rib 63 whose outside periphery $\mathbf{63}_s$ is provided with a lateral groove 64 and whose surface 65 extends inclinedly at an angle relative to the plane of the support surface 61, thus providing a radial step 66 of a height $i_l$. That surface 65 of a width b of 7 mm is followed towards a central opening 67 of a diameter $e_2$ of 14 mm by a surface 68, which is also inclined, of a width c also of 7 mm, with a radial step 69 of a height $i_2$. Provided on the other surf ace 70 of the top disk 13, which is upward in FIG. 14, is an insertion opening $\mathbf{70}_a$ for the head 56 of the arresting pin 16.

Letters 'A' through 'K' are impressed or embossed at the periphery $\mathbf{62}_s$ of the collar 62 at a pitch graduation of 33° and—as indicated at 95—one hundred scale marks or lines are similarly impressed or embossed, with a pitch graduation of 3.3°.

Figure 16:
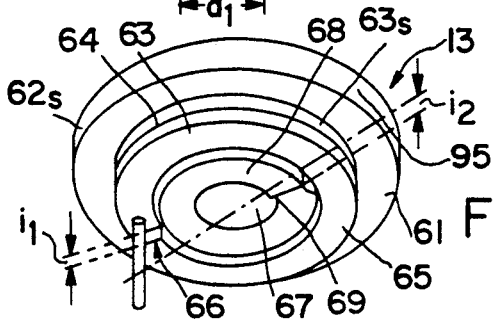
FIG. 16 is a view under an adjustment disk in FIG. 14.
Figure 17:
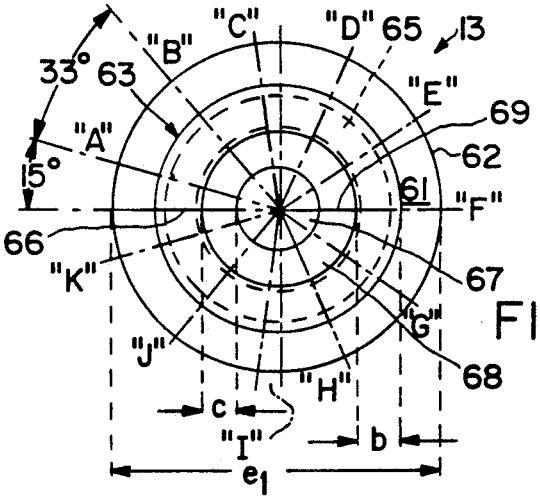
FIG. 17 is a plan view of the adjustment disk.
Figure 18:
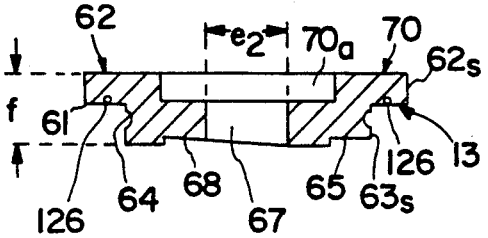
FIG. 18 is a side view of FIG. 17.
Figure 21:
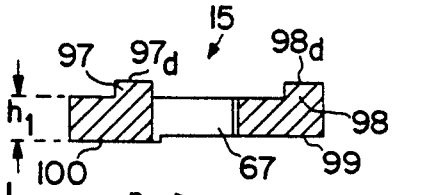
FIG. 21 is a side view of FIG. 20.

As FIGS. 16 and 17 show, the two inclined pressure surfaces 65 and 68 are displaced relative to each other through 180° and have a pitch in the clockwise direction of 2.18 mm per revolution. Disposed opposite a start dimension of 10.02 at the radial step 66, that dimension being closer to the collar 62, that is to say being seen at the upper end of the edge in FIG. 16, is an end dimension of 12.200 at the lower free end of the edge; the two pressure surfaces 65, 68 are provided with identical start and end dimensions.

Figure 19:
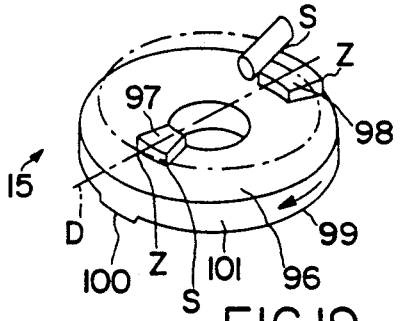
FIG. 19 is a perspective view of a pressure plate from FIG. 14.

The pressure plate 15 of a height $h_1$ of about 6 mm and a diameter $e_3$ of 42 mm, as shown in FIG. 19, bas on one of its surfaces 96, two surface portions 97, 98 which project therefrom and which are defined by radial side surfaces, at a common diameter D. The surface portions 97, 98 provide pressure faces $\mathbf{97}_d$, $\mathbf{98}_d$ as support means for the top disk 13; they are also displaced relative to each other through 180° and rise by 2.18 mm in the clockwise direction, per revolution. Here, the start point S in FIG. 19 is in each case downstream in the clockwise direction (dimension: 8.000) and the end dimension Z (8.182) follows after. The start and end dimensions of bath pressure faces $\mathbf{97}_d$, $\mathbf{98}_d$ are the same.

Disposed on the cooperating face 99 as a contact face is a retaining nose or projection 100 which prevents the pressure plate 15 from undesirable rotary movement by virtue of engaging into a cooperating detent means in the pressing block 78.

Figure 20:
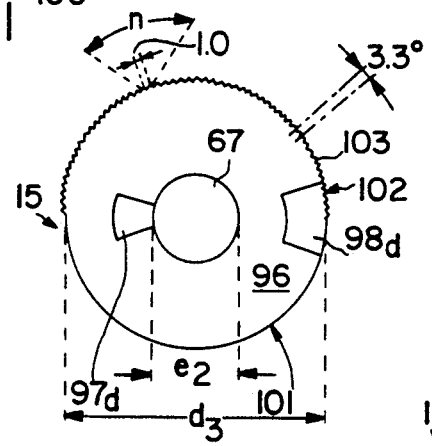
FIG. 20 shows plan views of the pressure plate in two different configurations.
Figure 22:
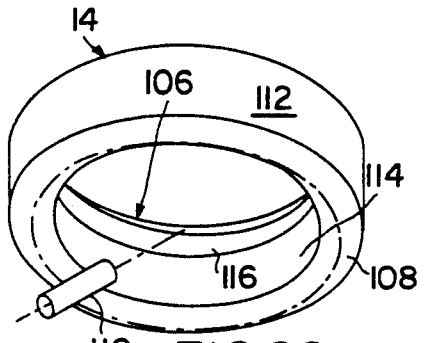
FIG. 22 is a view of the underneath of a further adjustment disk from FIG. 14.
Figure 23:
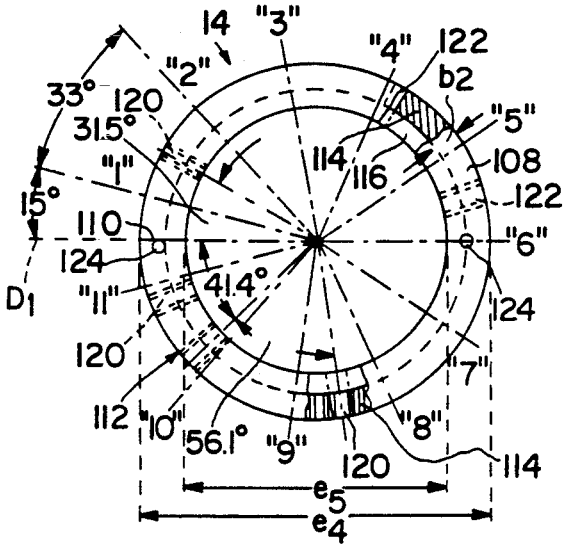
FIG. 23 is a plan view of the adjustment disk of FIG. 22.

FIG. 20 shows two configurations of the pressure plate 15, namely, in the bottom part, one with a smooth periphery 101 and, in the upper part, a configuration in which the periphery 102 has a tooth configuration extending parallel to the axis, with in this case one hundred and eight tooth grooves 103; they determine a wall angle n of 90°, with a tooth spacing of about 1.0 m. The drawing does not show, for example in FIG. 17, that in this embodiment, the outside periphery $\mathbf{63}_s$ of the annular rib 63 of the upper disk 13 is provided with a cooperating tooth configuration.

Figure 24:
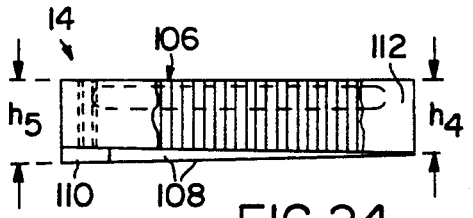
FIG. 24 is a side view of FIG. 23.
Figure 25:
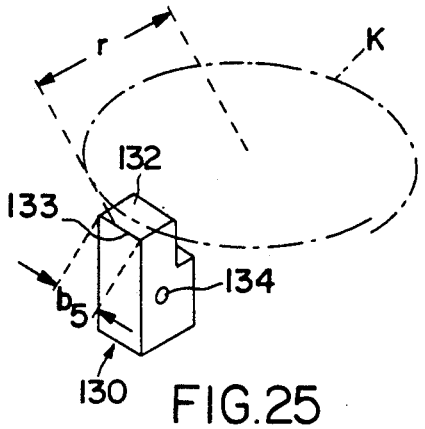
FIG. 25 is a perspective view of an adjustment wedge or key in FIG. 14.
Figure 26:
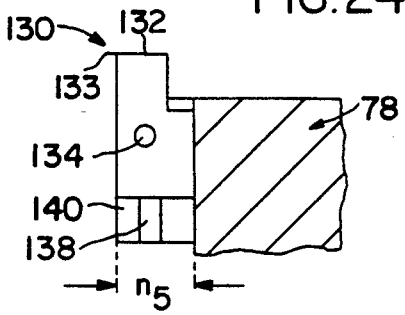
FIG. 26 is a side view of FIG. 25.
Figure 27:
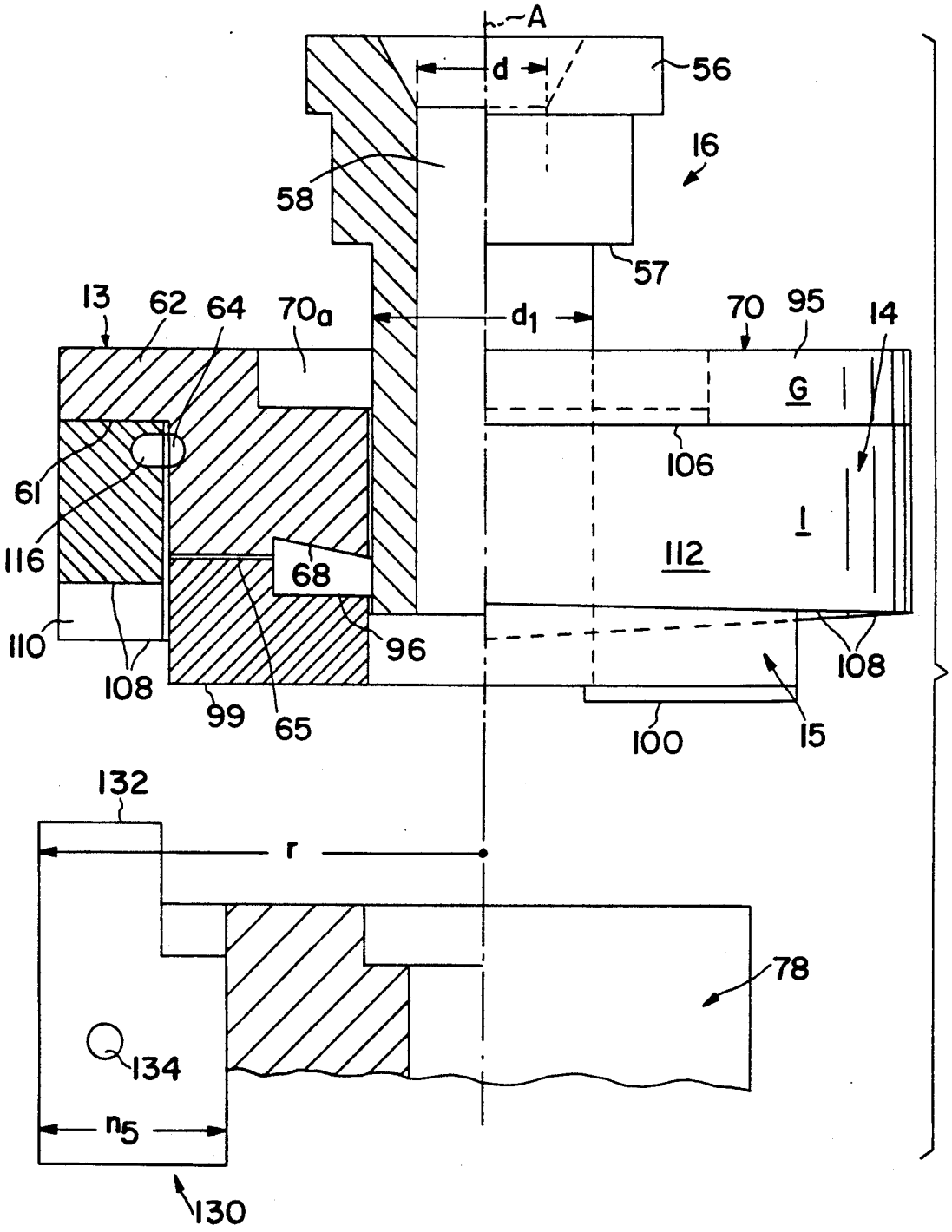
FIG. 27 is a view in section through parts of FIG. 14 on an enlarged scale.

The lower disk 14 of a height $h_4$ of 10.5 m has—in each case outwardly—an upper annular radial pressure face 106 of an outside diameter $e_4$ of 56 mm, an inside diameter $e_5$ of 42 mm and, on the other side, a base or support pressure face 108 of a pitch or gradient of 2.18 m per revolution, rising in the clockwise direction from and to a radial edge 110. The latter has a start dimension of 10.500 and an end dimension of 12.682. Disposed at the periphery 112 of the lower disk 14 are numbers from '1' to '11' with a pitch of 33°, together with 100 scale lines or marks with a pitch of 3.3°, as shown in FIG. 24.

Between the upper pressure face 106 and the lower base or support pressure face 108 is an annular wall 114 which, in the region of an inwardly disposed annular groove 116, is of a width $b_2$ of about 7 mm. The annular groove 116 accammodates a retaining insert (not shown) which engages into a cooperating groove 118 in the upper disk and in that way holds the lower disk 14 in position.

In place of the annular groove 116, radial through bores 120 provided with a screwthread may afford spring-loaded ball detents (nat shown) or the like resilient retaining or detent portions which are directed towards the axis A and which at the other end project into the cooperating groove 118.

Reference numeral 122 identifies radial screwthreaded bores—which are 3 mm away from the pressure face 108—for receiving resilient pressure portions; the latter engage in a retaining or detent mode into the tooth configuration 102/103 of the pressure plate 15.

Two screwthreaded bores 124 which extend parallel to the axis can be seen at the diameter $D_1$ of the lower disk 14, for receiving sprung retaining or detent elements which can be engaged into recesses 126 in the surface 61 of the top disk 13.

Disposed beneath the lower disk 14 is an adjustment wedge or key 130 with an upper pressure face 132 of a width $b_5$ of 10 mm on a construction circle K. A radius r of 30 mm extends in FIG. 25 between the center point of the circle K and the outside edge 133, which is remote therefrom, of the pressure face 132. The pressure face 132 has a pitch or gradient in the clockwise direction of 2.18 mm per revolution. The radial wedge length $n_5$ measures 12 mm.

Fitted into a transverse bore 134 in the adjustment wedge or key 130 is a guide pin 136 which engages into side grooves 138 in two guide jaws 140, between which the adjustment member 130 is mounted. They are formed laterally on a pressing block 78, into the central bore 144 in which engages the countersunk screw 60. A radial edge groove 146 in the block 78 extends from the central bore 144, as a cooperating retaining portion for the projection 100 on the pressure plate 15.

When the upper adjustment disk 13 is turned about the arresting pin 16, it is screwed on the two support points $97_d$, $98_d$ of the pressure plate 15 downwardly or upwardly, depending on the respective direction of rotation. Only 11/12ths of a revolution is possible, with the adjustment disk 13 being adjusted by 2 m in respect of height. That is made possible by the two spiral-like pressure faces 65, 68 on the upper adjustment disk 13, which face in the pressing direction x. The depth of pressing of the device is determined in that way.

The lower adjustment disk 14 which bears against the upper adjustment disk 13 serves for adjustment of the insulation crimper and is supported by the upper adjustment disk 13. Bearing against it is the middle adjustment wedge or key 130 which is guided in the block 78. The adjustment member 130 transmits the force to the insulation crimper.

It is to be noted that the above-described inclined pressure faces 61, 68, $97_d$, $98_d$, 108 are self-locking. The described retaining means are additionally provided, which permit accurate setting to 0.02 mm.

I claim:

1. A device for connecting a wire to a contact element or the like by deformation of clamping members by means of pressure elements of a crimping tool arranged interchangeably in a press, which comprises: an adjustment disk including an upper adjustment disk and lower adjustment disks, wherein the two adjustment disks lie one upon the other in coaxial relationship, and wherein the upper and lower adjustment disks are coaxially rotatably associated with each other with the upper adjustment disk having a support surface which faces the lower adjustment disk, with the support surface having a plane thereof; a holding member for holding the upper disk, wherein said upper and lower disks are rotatable about the axis of the holding member; a pressure plate surrounded by the lower adjustment disk and having an upper surface engagable with the supporting surface of the upper disk; and wherein both disks are provided with at least one annular surface which rises spiral-like relative to the supporting surface.

2. A device according to claim 1 wherein each annular surface has a radial step edge as the boundary between the beginning and the end of the rise.

3. A device according to claim 2 wherein the radial step edges have heights thereof and wherein the heights of said step edges are the same.

4. A device according to claim 1 including at least one axis-parallel retaining element of the lower disk is engagable into a cooperating detent means of the upper disk.

5. A device for connecting a wire to a contact element or the like by deformation of clamping members by means of pressure elements of a crimping tool arranged interchangeably in a press, which comprises: an adjustment disk including an upper adjustment disk and lower adjustment disks, wherein the two adjustment disks lie one upon the other in coaxial relationship, and wherein the upper and lower adjustment disks are coaxially rotatably associated with each other with the upper adjustment disk having a support surface which faces the lower adjustment disk, with the support surface having a plane thereof; a holding member for holding the upper disk, wherein said upper and lower disks are rotatable about the axis of the holding member; a pressure plate surrounded by the lower adjustment disk and having an upper surface engagable with the supporting surface of the upper disk; and wherein both disks are provided with at least one annular surface which rises spiral-like relative to the supporting surface; and wherein the lower adjustment disk has a central opening, and wherein the pressure plate is dimensioned so that it can be inserted into the central opening in the lower adjustment disk and is provided at the surface thereof with two part-circular pressure faces having a rising surface as support points for the upper adjustment disk.

6. A device according to claim 5 wherein said annular surfaces have a gradient in the clockwise direction with a height of the annular surfaces of 2.18 mm.

7. A device according to claim 6 wherein the upper disk has an outside diameter of 56 mm.

8. A device according to claim 5 wherein the pressure faces have a height of 2.18 mm.

9. A device according to claim 8 wherein the pressure plate has an outside diameter of 42 mm.

10. A device for connecting a wire to a contact element or the like by deformation of clamping members by means of pressure elements of a crimping tool arranged interchangeably in a press, which comprises: an adjustment disk including an upper adjustment disk and lower adjustment disks, wherein the two adjustment disks lie one upon the other in coaxial relationship, and wherein the upper and lower adjustment disks are coaxially rotatably associated with each other with the upper adjustment disk having a support surface which faces the lower adjustment disk, with the support surface having a plane thereof; a holding member for holding the upper disk, wherein said upper and lower disks are rotatable about the axis of the holding member; a pressure plate surrounded by the lower adjustment disk and having an upper surface engagable with the supporting surface of the upper disk; and wherein both disks are provided with at least one annular surface which rises spiral-like relative to the supporting surface; and wherein the pressure plate is provided with a lower surface as a support surface with a wedge-like retaining projection which projects therefrom.

11. A device according to claim 10 including a pressing block with an edge groove which axially adjoins the lower disk, wherein the retaining projection of the pressure plate fits into the edge groove in the pressing block.

12. A device according to claim 11 wherein the lower disk has a lower surface, and including an adjustment wedge or key with a substantially flat surface associated with the lower surface of the lower disk, wherein said adjustment key is movably secured to the pressing block.

13. A device for connecting a wire to a contact element or the like by deformation of clamping members by means of pressure elements of a crimping tool arranged interchangeably in a press, which comprises: an adjustment disk including an upper adjustment disk and lower adjustment disks, wherein the two adjustment disks lie one upon the other in coaxial relationship, and wherein the upper and lower adjustment disks are coaxially rotatably associated with each other with the upper adjustment disk having a support surface which faces the lower adjustment disk, with the support surface having a plane thereof; a holding member for holding the upper disk, wherein said upper and lower disks are rotatable about the axis of the holding member; a pressure plate surrounded by the lower adjustment disk and having an upper surface engagable with the supporting surface of the upper disk; and wherein both disks are provided with at least one annular surface which rises spiral-like relative to the supporting surface; and wherein the periphery of the pressure plate is toothed in axis-parallel relationship to the adjustment disks.

14. A device according to claim 14 wherein the lower adjustment disk is radially adjacent the pressure plate and has an inside surface meshing with the toothed periphery of the pressure plate.

15. A device according to claim 13 wherein the lower adjustment disk is radially adjacent the pressure plate and has at least one retaining element which engages into the tooth configuration of the pressure plate.

* * * * *

UNITED STATES PATENT AND TRADEMARK OFFICE
CERTIFICATE OF CORRECTION

PATENT NO. : 5,289,713

DATED : March 1, 1994

INVENTOR(S) : Bernhard Schafer

It is certified that error appears in the above-identified patent and that said Letters Patent is hereby corrected as shown below:

In Column 1, line 42, change "$m^2$" to read --$mm^2$--;

In Column 2, line 9, change "sam" to read --same--;

In Column 3, line 52, after "$89_a$" delete "a";

In Column 4, line 14, change "cringing" to read --crimping--;

In Column 4, line 19, change "rain" to read --ram--;

In Column 4, line 22, change "cringing" to read --crimping--;

In Column 4, line 32, change "Unlike" to read --U-like--;

In Column 4, line 33, change "me" to read --one--;

In Column 4, line 50, change "screw&" to read --screwed--;

In Column 5, line 31, change "14 m" to read --14 mm--;

In Column 6, line 4, change "bas" to read --has--;

In Column 6, line 15, change "bath" to read --both--;

In Column 6, line 27, change "1.0 m" to read --1.0 mm--;

In Column 6, line 32, change "10.5 m" to read --10.5 mm--;

In Column 6, lines 36-37, change "2.18 m" to read --2.18 mm--;

In Column 6, line 47, change "accammodates" to read --accommodates

UNITED STATES PATENT AND TRADEMARK OFFICE

CERTIFICATE OF CORRECTION

PATENT NO. : 5,289,713

DATED : March 1, 1994

INVENTOR(S) : Bernhard Schafer

It is certified that error appears in the above-identified patent and that said Letters Patent is hereby corrected as shown below:

In Column 6, line 49, after "upper disk" --13-- should be inserted;

In Column 6, line 53, change "(nat shown)" to read --(not shown)--;

In Column 7, line 22, change "2 m" to read --2 mm--;

In Column 10, claim 14, line 7, "claim 14" should read --claim 13--.

Signed and Sealed this

Seventh Day of March, 1995

Bruce Lehman

*Attest:*

BRUCE LEHMAN

*Attesting Officer*

*Commissioner of Patents and Trademarks*